United States Patent [19]

Kraus

[11] Patent Number: 4,774,999

[45] Date of Patent: Oct. 4, 1988

[54] PROCESS FOR AUTOMATIC CONTROL OF THE STARTUP OF A CONTINUOUS CASTING APPARATUS

[75] Inventor: Andre Kraus, Esch/Alzette, Luxembourg

[73] Assignee: Arbed S.A., Luxembourg, Luxembourg

[21] Appl. No.: 81,621

[22] Filed: Jul. 31, 1987

Related U.S. Application Data

[63] Continuation of Ser. No. 860,669, May 7, 1986, abandoned.

[30] Foreign Application Priority Data

May 7, 1985 [LU] Luxembourg ..... 85878

[51] Int. Cl.[4] ..... B22D 11/18; B22D 11/20

[52] U.S. Cl. ..... 164/453; 164/454; 164/483; 164/449; 164/413

[58] Field of Search ..... 164/483, 452, 453, 454, 164/413, 449, 450

[56] References Cited

FOREIGN PATENT DOCUMENTS 58-84652 5/1983 Japan ..... 164/453

58-77761 5/1983 Japan ..... 164/453

*Primary Examiner*—Kuang Y. Lin

*Attorney, Agent, or Firm*—Herbert Dubno

[57] ABSTRACT

At the latest before response of the measuring mechanism which senses the filling state of the melt tundish the opening rate of the outlet of the tundish is brought to near its standard opening rate and, after obtaining a clear signal from the filling state measuring mechanism or reaching a first predetermined filling height, the withdrawal mechanism is switched on and the withdrawal speed delayed for determination of the opening rate of the outlet. Advantageously the speed of the discharge rollers is measured by a tachometer which transmits a normalized signal which is then multiplied by a signal determined by the standard opening rate. The resultant signal controls the opening rate of the outlet. After the running stage of the withdrawal mechanism or after attaining a second predetermined filling height which is higher than the first filling height, only an I-governing branch of the control circuit controls the opening rate of the outlet and, after reaching a third predetermined filling height, which corresponds approximately with the standard desired filling height, control is transferred to an I-P regulation.

12 Claims, 3 Drawing Sheets

PROCESS FOR AUTOMATIC CONTROL OF THE STARTUP OF A CONTINUOUS CASTING APPARATUS

This is a continuation of co-pending application Ser. No. 860,669, filed on May 7, 1986, now abandoned.

FIELD OF THE INVENTION

My present invention relates to an automatic process and apparatus for the continuous casting of metal, e.g. steel, and, more particularly, to a process for controlling the startup of a continuous metal casting apparatus.

BACKGROUND OF THE INVENTION

A continuous casting apparatus can comprise a water cooled mold which is provided with a tundish having an adjustable outlet for a melt and an extraction, strand advancing or withdrawal mechanism for the solidified product or strand.

The mold is provided with a measuring mechanism for measurement of the state of filling of the mold which controls the speed of the withdrawal mechanism, or its withdrawal rollers if it is so equipped during free running operation, or the opening of the tundish outlet.

Before the start of casting operation the lower mold opening is closed with a starting "head" formed by a dummy bar; when the molten metal is then supplied the molten steel fuses with the head onto which cold scrap can be applied to facilitate the fusion.

By the water cooled mold so much heat is drawn from the hot flowing metal that a rigid shell of the strand forms against the mold wall. As soon as the state of filling of the mold is such that the level of the metal has reached a predetermined height, the withdrawal mechanism is switched on and the cooled strand is drawn off while continuously solidifying. The continuous casting can then be subjected to classical continuous metal casting control process.

An automatic casting process has problems since the measuring mechanism is mounted in the vicinity of the desired (setpoint) height of the bath level and useable measurements are only transmitted when the bath level approaches its desired level.

During casting vigorous bath motion and splashing occurs, which can result in erroneous measurements of the state of filling or make difficult the interpretation of such measurements.

An automatic startup of the casting process is described in German Patent Document No. 32 21 708. The process described there for filling the mold is characterized by an intermittent automatic opening of the outlet for dollopwise filling of the mold over a time interval from the beginning of melt feed until the filling of the space in the vicinity of the starting head and/or until the decay of the initial strong bath motions in the mold.

From the Belgian Patent Document BE No. 704,306 it is known to fill the mold continuously in a first stage of a casting process and, when the height of the reservoir metal level is detected by the measuring mechanism to again close the outlet. Subsequently the withdrawal mechanism is started and the outlet is placed under control of a P-governing branch of an electronic control circuit, i.e. a proportional (P) controller.

However one does not choose this kind of process when casting articles with a small cross sectional area. Here the volume filled by the steel is very small; the thermal inertia of the steel-mold system is drastically reduced. Also the stopper which closes the outlet is brought from the open to the closed positions in about 0.8 seconds by the customary adjusting drive. Thus during the measurement of a first value by the measuring mechanism, the outlet can only close half way in the available time.

In dollopwise filling with very cool charges (say, about 20° C. above the melting point) there is the great danger that with small stopper displacement the heat input or delivery to the outlet and mold per stopper stroke will become too small and the outlet or the downcomer or immersion tube will become clogged.

In casting after changing the immersible tube, this danger is even greater since the immersible tube is not preheated. It can also be observed with very inferior grades of steel during a pause in a stroke of the stopper that the steel will congeal in the immersible tube and in the next stroke the immersible tube will be broken loose from the reservoir. To treat this condition the stopper stroke can be lengthened at the outlet so that the largest possible quantity of heat per stroke is delivered to the immersible tube.

This approach is, however, limited since a lengthening of the open time automatically means an increase of the stopper stroke and a large opening at the outlet at the time and in the region of the level measurement which can lead to a steel overflow. Also in this process the indefinite stopper position on reaching the switchover point is not beneficial for adjustment of the apparatus from the initial pouring stage to the regulated stage.

With charges having very high Al-content(without CaSi) these problems are still greater. Here the alumina builds up at the outlet on every closing of the stopper so that the stopper null position is displaced upwardly. Because of a nonuniform structure of the alumina deposit the stopper can no longer be tightly closed. An even higher energy input must be used here in order to avoid clogging the apparatus.

OBJECTS OF THE INVENTION

It is an object of my invention to provide an improved process for automatic control of the startup of a continuous casting apparatus.

It is another object of my invention to provide an improved process for automatic control of the startup of a metal casting apparatus which can be used to cast products having small cross sectional areas without clogging either the outlet of the tundish or the immersible tube.

It is also an object of my invention to provide an improved process for startup of a metal casting process which allows a reliable castin using a melt whose temperature is close to the melting point.

SUMMARY OF THE INVENTION

These objects and others which will become more readily apparent hereinafter are attained in accordance with my invention in a process for automatic control of the startup of a metal casting apparatus comprising a water cooled mold, which is provided with a tundish having an adjustable outlet for a melt and a withdrawal mechanism for the solidified strand. The mold is provided with a measuring mechanism for measurement of the state of filling of the mold which controls the speed of the withdrawal mechanism, or its withdrawal rollers, if it is so equipped, during free running operation or the opening of the outlet.

According to my invention at least shortly before the response of the measuring mechanism to the state of filling the opening rate of the outlet is brought to about the standard opening rate and, after obtaining a clearly useable signal from the measuring mechanism or ween a first predetermined state of filling has been reached, the withdrawal mechanism is switched on and the speed of the withdrawal mechanism (controlled by the level in the mold in the usual feedback loop) determines or contributes to the determination of the opening rate of the oullet.

Advantageously from the start of casting to either the obtaining of a clearly useable signal from the measuring mechanism or to the first predetermined state of filling thereof (which can be the same point in time), the opening rate of the outlet is near the standard opening rate.

In another feature of my invention at the start of casting a dollop or portion of metal is permitted to run into the mold, and the opening rate of the outlet is larger than the standard opening rate during casting. Furthermore the opening rate of the outlet can be at least twice as large as the standard opening rate during casting.

Advantageously one closes the outlet at least at a short time before the opening rate of the outlet is brought close to the standard opening rate.

According to further features of my invention the withdrawal mechanism has a plurality of withdrawal rollers clamping the cast product and the speed of the withdrawal rollers is measured by means of a tachometer which transmits a normalized tachometer signal which is multiplied by a signal determining the standard opening rate and the resultant signal from the multiplication controls the opening rate of the outlet.

Advantageously after the running stage of the withdrawal mechanism or after attaining a second predetermined filling height greater than the first filling height, control of the opening rate of the outlet is transferred completely to an I-governing branch of a control circuit, i.e. an integral controller or I controller). After reaching a third predetermined filling state which has a height approximately equivalent to the desired height in the desired filling state, the opening rate of the outlet is put under I-P regulation, i.e. integral-proportional or PI control.

My invention provides a substantially more reliable casting process. The regulation and control of the process is provided with economical and tested electronic components. It also provides an opportunity to cast steel whose melt temperature is just over the melting point.

BRIEF DESCRIPTION OF THE DRAWING

The above and other objects, features and advartages of my invention will become more readily apparent from the following description, reference being made to the accompanying highly diagrammatic drawing in which.

SPECIFIC DESCRIPTION

Figure 1:
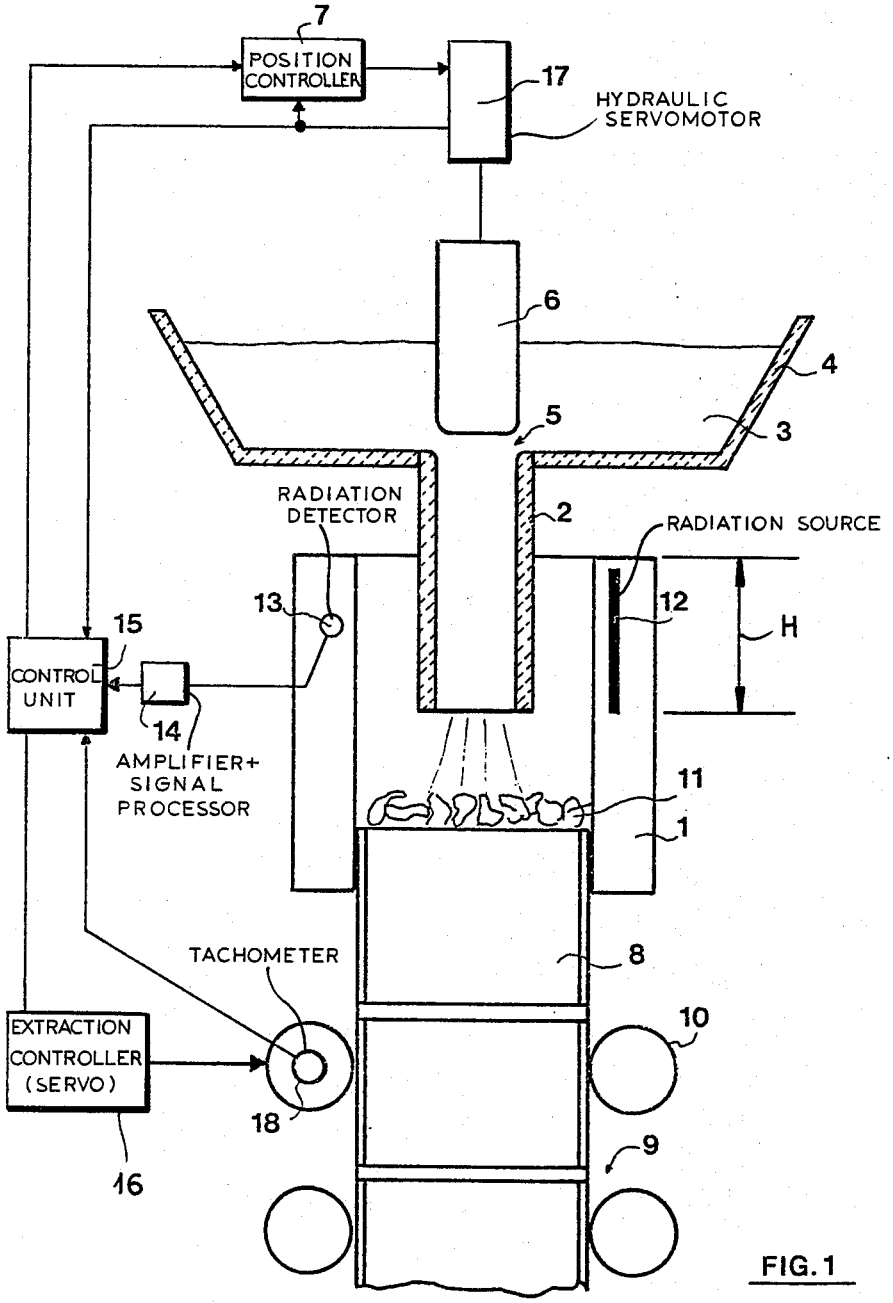
FIG. 1 is a schematic cross sectional view of a continuous casting apparatus used in the process according to my invention.

As shown in FIG.1 the upper end of a water cooled continuous casting mold 1 is supplied with steel melt 3 by an immersion or dip tube 2. The melt 3 can be found in an intermediate vessel or tundish 4 whose outlet 5 is closable by stopper 6. The position of the stopper 6 is determined by a hydraulic positioning member 17 such as a hydraulic servomotor. The configuration of the positioning member 17 depends on a regulating device 7.

The lower side of the mold 1 is closed by starting head 8 on which cold scrap iron 11 is disposed; the cooled strand or continuous casting connected therewith is clamped into the outlet rollers 10.

A radiation source 12, usually Co-60 extending over a height H, is positioned at the upper end of the mold 1. The radiation originating from the source 12 is received by a sensor 13.

After suitable amplification and signal processing (circuit 14) the received signal is transmitted to the electrical control unit 15. The metal level and state of filling is determined from the attenuation of the radiation reaching the sensor 13. In the following description the filling height is reported as a percentage of the measuring range. Thus a nominal filling height of 70% means that height which is reached when an output signal of 70% of the maximum signal range arises.

Figure 2:
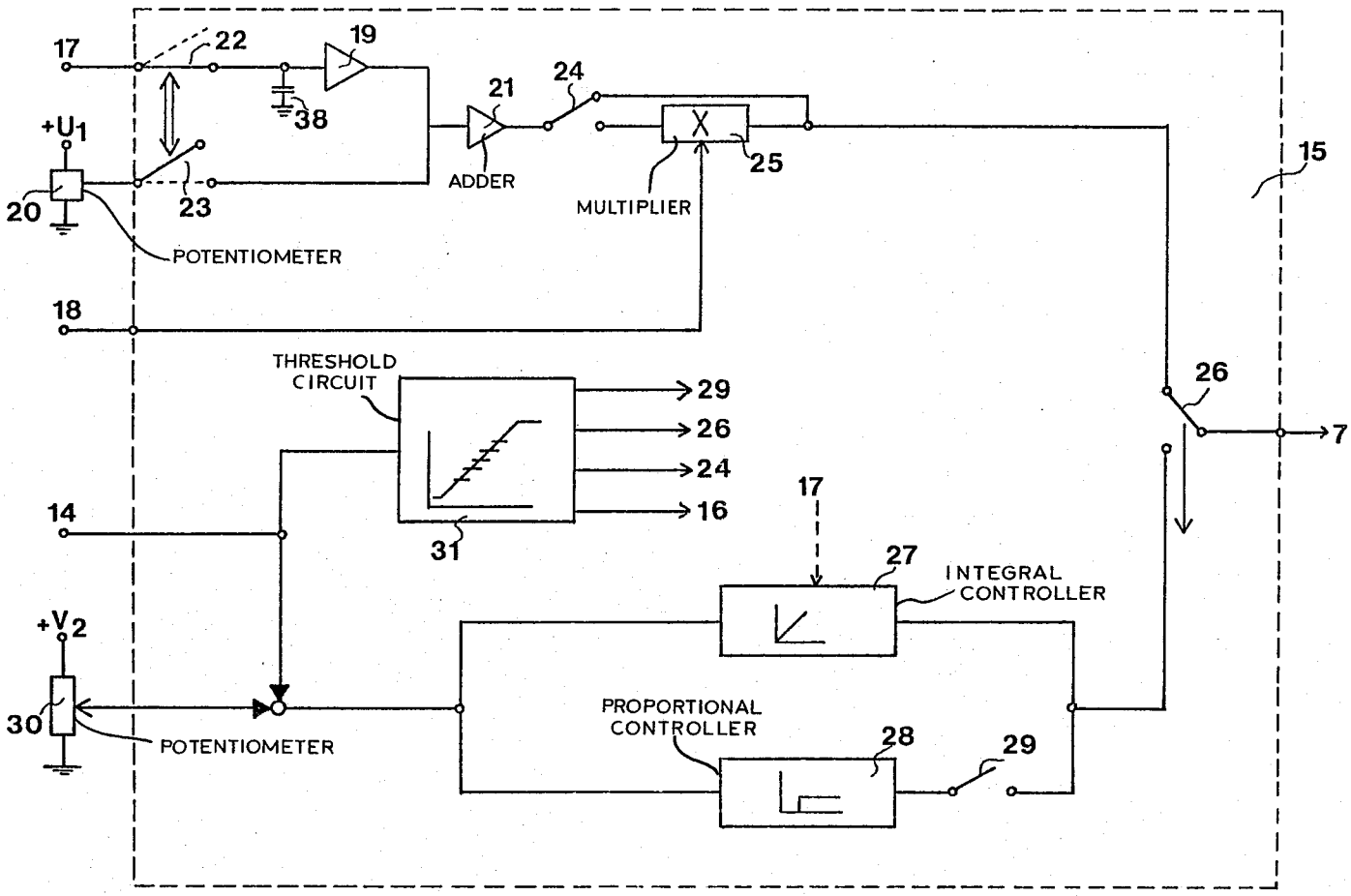
FIG. 2 is a circuit diagram of an electrical control unit used to control startup in the process according to my invention.

The electrical control unit 15 which is shown in more detail in FIG. 2 receives the filling height signal from the amplifier-processor 14 and the position of the stopper 6 from the positioning member 17 and acts on the regulating device 7 and the tachometer control 16 of the withdrawal mechanism 9. The control unit 15 moreover receives the withdrawal speed of the (cold) strand by a tachometer 18 attached to a withdrawal roller 10.

FIG. 2 shows the control unit 15 in greater detail. The configuration of the various switches prior to casting is shown. By using known electronic design features the switches change configuration only once, that is, during pouring to a give metal level the switches can not reverse to their initial configuration.

The condenser 38 retains the instantaneous zero setting of the stopper 6. A voltage is developed at potentiometer 20 which from experience is known to lead approximately to the standard stopper position in casting, while the bath height in the mold is adjusted to its desired or set-point value by the potentiometer 30.

The limiting indicator or threshold circuit 31 acts on the switching mechanisms or switches 24, 26, and 29 as well as the tachometer control 16 as soon as the metal in the mold reaches a predetermined level. In the multiplying unit 25 the stopper position (whose zero setting position is allowed for by the condenser 38 and the amplifier 19) set by the potentiometer 20 is multiplied by a value proportional to the outlet speed of the product. Further the circuit also includes an I-governing branch (I-controller) 27 as well as a P-governing branch (P-controller) 28, whereby the governing branches not only are adjusted for control of the startup operation but also for the normal operation.

The operation at startup is as follows: The switch 23 is closed and simultaneously the switch 22 is opened. The correct zero setting of the stopper 6 is retained fixed in condenser 38 and the desired set-point starting value fixed in the potentiometer is provided directly to the regulating device 7 by the adder 21 after a null correction. This desired starting value corresponds advantageously to the middle stopper position during casting. In any case the outlet 5 should neither be opened too much, because then a steel overflow occurs, nor should it be opened too little, because then the outlet becomes plugged.

As soon as the casting level measuring mechanism reaches a 20% filled condition, the casting apparatus starts. Simultaneously the switching unit or switch 24 reverses; the desired stopper opening value is changed additionally by the multiplier block 25 depending on the actual pouring speed.

The signal transmitted by the tachometer 18 is normalized, that is, the multiplier value is between 0 (casting apparatus idle) and 1 (desired speed attained). Because of that the stopper first travels a short distance toward the outlet 5 (this of course reduces the pouring or casting speed) and then is opened proportionally to the startup curve of the withdrawn mechanism.

Should a breakdown occur in the withdrawn mechanism the outlet 5 is most quickly shut. The multiplier value can be dependent on the casting speed linearly or in a first speed range logarithmically then linearly or exponentially. Particularly for very small cross sections (smaller than 100 $mm^2$) one must make a careful determination of the mathematical dependence of the multiplier value on the casting speed by routine experiment to avoid a breakthrough or an overflow in casting.

On reaching the 50% state of filling the necessary position control is replaced by an equalizing control and of course that control is switched on by reversal of the switching unit 26 with the exception of the I-branch 27. It is understood that until this time the I-governing branch 27 should be reset for the above described control of the position of the stopper 6 (see the dashed arrow and reference character 17 in FIG. 2), since it otherwise would have attained its saturation limit and would cause an extremely fast rise of the stopper 6.

At an about 70% state of filling, which as described above corresponds to the desired filled condition, then by closing of the switch unit 29 of the P-governing branch 28 the control is switched on. Now the stopper position is subjected to a classical I-P regulation, in which the actual value transmitted by amplifier 14 is compared with a desired value set by potentiometer 30 and the stopper position is changed according to the difference. From experience a premature activation of the P-governing branch or branch 28 results in a violent variation in the metal flow rate as well as an accompanying steel overflow risk. In no case should the P-governing branch 28 be switched on before the I-governing branch 27.

Instead of as described above to bring the opening rate of the outlet 5 immediately to the standard opening rate, it is advantageous in another embodiment of my invention to provide an immediate input of a large quantity of heat: first a large portion of metal is allowed to flow into the mold and then the opening rate of the outlet 5 is returned to the standard opening rate. For this purpose instead of one potentiometer 20 two are used (see the potentiometers 120 and 220 in FIG. 3 which shows the upper part of the block diagram of the circuit of FIG. 2 with some modifications).

With the potentiometer 220 and with the potentiometer 120 as described in connection with FIG. 2 the opening rate corresponding to the large portion of added metal is adjusted to the central stopper position $W_c$ in casting. Components in the embodiment of FIG. 3 which are the same is in the embodiment of FIG. 2 are given reference numbers equal to the reference number used in FIG. 2 plus 100.

Figure 3:
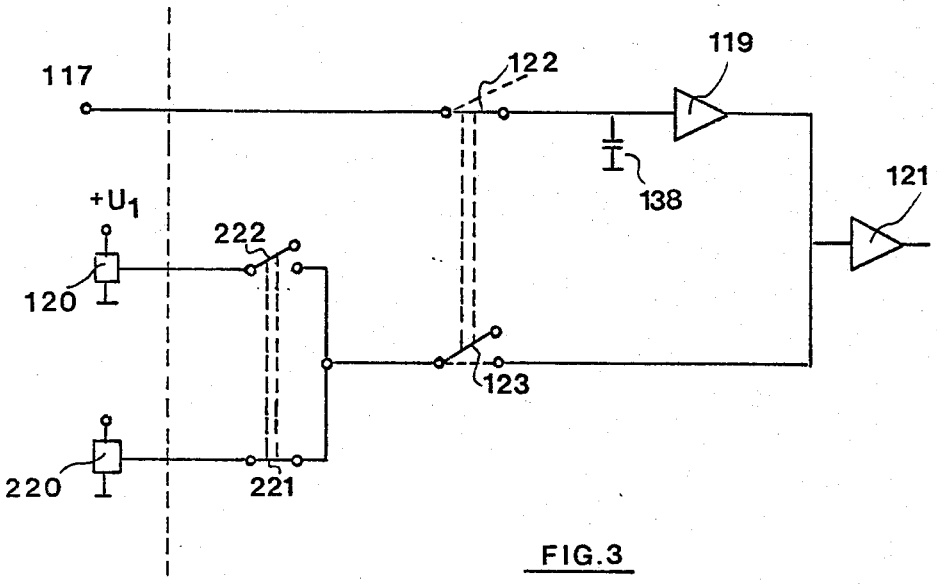
FIG. 3 is a circuit diagram of a different electric control unit used to control the startup of an alternative embodiment of the process according to my invention.
Figure 4:
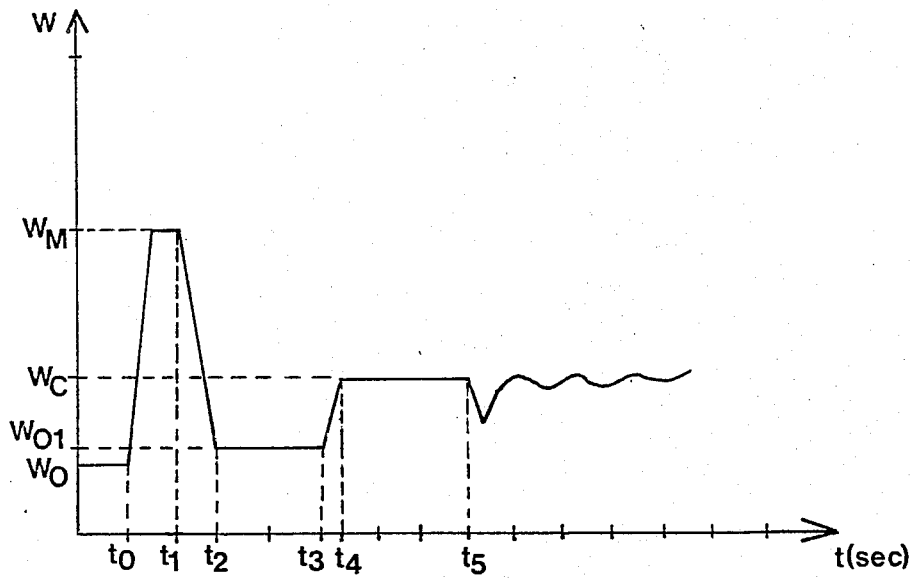
FIG. 4 is a graphical illustration of the relationship between stopper position and time during my casting process.

In the embodiment of FIG. 3 before casting begins the switch 221 is closed and the switch 222 is opened. During casting the switch 123 is closed (at time $t_0$—see FIG. 4) and the stopper 6 moves from the null position $W_o$ until at the predetermined maximum value $W_M$. After about 1 second (time$=t_1$) the switch 123 is opened (switch 122 is closed) and the stopper 6 moves back into its new null position required by the hardened metal. Approximately simultaneously with the switch 123 the switches 221 and 222 are reversed, so that the actual state of the potentiometer 120 controls the position of the stopper 6 as soon as the switch 123 (time$=t_3$) is closed. The waiting time depends on the distribution, the heating of the melt, and the quality of the steel and amounts to between 0 and about 15 seconds. It has proved advantageous when a pause is not required to close the base outlet 5 completely in a very short time in order in subsequent process steps to be able to allow for the instantaneous null position of the stopper; $W_{01}$. At time$=t_3$ the stopper 6 moves into a position $W_c$, which depends on the voltage developed across the potentiometer 120 as well as the charge on the condensor 138. At time$=t_5$ the 20% state of filling is reached, which starts the outlet mechanism starts. At the 30% state of filling the I-governing branch 27 takes control.

It is important during the casting to move the stopper member into a position in which a closure of the pouring opening or outlet 5 still occurs when the measuring mechanism transmits a first useable signal. It is also important to be able to change the opening rate depending on the casting speed. The fastest possible running of the product at the desired speed is desirable and has proved advantageous in the controlling process according to my invention.

Although the process according to my invention has been illustrated in detail by analog switches, naturally it is possible to perform the required automatic control and regulation with digital electronics as long as the digital electronics has a sufficiently short cycle time.

I claim:

1. A process for automatic control of a startup of a continous casting apparatus having a tundish for receiving molten metal, a stopper vertically movable in the tundish for defining a range of openings of an outlet of said tundish in accordance with respective positions of the stopper, a mold receiving and cooling said moten metal, said mold having a level sensor, an immersion tube connecting said tundish with said mold and a withdrawal mechanism having a plurality of withdrawal rollers downstream of said mold, comprising the sequential steps of:

(a) shifting the stopper to a predetermined maximum upper position forming an opening larger than a standard opening corresponding to a standard continuous-casting position of the stopper for introducing into a mold of said apparatus through the immersion tube a large amount of molten metal for preheating said mold;

(b) solidifying a part of said molten metal in said mold;

(c) retaining said stopper at said predetermined maximum position for a short period of time sufficient to fill said mold with said molten metal to a level of filling at which a first stable signal, free from splashing signals resulting from splashes of incoming molten metal, is produced by the sensor;

(d) starting the movement of the rollers of the withdrawal mechanism upon the lapse of said short period of time after said stable signal is produced and controlling the speed of said rollers corresponding to the casting speed of said incoming metal by measurement of the roller speed;

(e) moving said stopper down towards said outlet to a second position below said standard position;

(f) retaining said stopper at said second position for another period of time for distributing the incoming metal in said mold;

(g) moving said stopper up to said standard position to form said standard opening; and (h) thereafter controlling the position of the stopper by continuously comparing a measured level of the molten metal determined by said sensor with a preset value of said level.

2. The process defined in claim 1 wherein said larger opening in step (a) is at least twice as large as said standard opening.

3. The process defined in claim 1 wherein said outlet of said tundish is closed by said stopper during step (e) for the period of time of step (f).

4. The process defined in claim 1 wherein said short period of time is about 1 sec.

5. The process defined in claim 1 wherein the control of step (h) is an integral control of the position of said stopper beginning at least at a level of filling of about 30% of a predetermined filling by said molten metal, and a proportional control regulating said position of said stopper beginning at about 70% of said predetermined filling.

6. The process defined in claim 5 wherein said stable signal free from splash signals occurs at a level of about 20% of said predetermined filling.

7. An apparatus for continuous casting of metal, comprising:

a tundish receiving incoming molten metal and having an outlet in a bottom thereof for passing of molten metal;

a stopper shiftable up and down in said tundish opening and closing said outlet, said stopper having a predetermined maximum position defining a large opening of said outlet;

an immersion tube connected to said outlet for conducting said molten metal;

a continuous casting mold below said tundish and connected therewith by said tube, said mode receiving said molten metal;

a withdrawing mechanism below said mold having a starting head closing said mold and forming a bottom of said mold for distributing the metal being cooled in said mold, said mechanism including a plurality of withdrawing rollers along flanks of a continuous casting emerging from said mold; and means controlling the opening of said outlet of said tundish, said means comprising:

a detector for a level of said incoming metal, said detector having a source of radiation at an upper part of said mold, and a sensor receiving a signal originating from said source, a speed sensor detecting an actual speed of said rollers, an amplifier receiving a signal from said sensor of said detector, and a controller receiving a signal of an actual level of said incoming metal from said amplifier and said signal of said actual speed, said controller having a circuit for moving said stopper from a null position up to said maximum position, and a threshold circuit controlling a sequence of said stopper shifting to switch on said speed sensor only after said maximum position of said stopper reached and said maximum position is retained for a short period of time, allowing said mold to be filled with said incoming metal to a first level of filling of said mold corresponding to a first stable from said detector free from splashing signals with subsequent moving of said stopper toward said outlet, to retain said stopper at a second position below a standard position of the stopper for distribution of metal in said mold, to shift said stopper to said standard position, to disconnect a circuit shifting said stopper between said maximum position and the second position, to connect an integral control circuit, shifting the position of the stopper to said standard position in response according to an increasing level of said filling of said mold by said incoming metal, and upon reaching a predetermined level of said filling, to connect a proportional control circuit controlling said position of said stopper in accordance with a changing level of said filling compared with a preset value of said predetermined level of the filling.

8. The apparatus defined in claim 7, further comprising analog switches so that one of said switches being turned on connects said speed sensor to said circuit moving the stopper from the null position to said maximum position, another switch upon reaching a certain value of the filling connects the integral control circuit simultaneously disconnecting said circuit moving the stopper to the maximum position and after said preset value is reached a third switch switches said proportional control circuit.

9. The apparatus defined in claim 7 wherein said circuit for moving said stopper from said null position to the maximum position is disconnected at a level of about 30% of the filling of said mold.

10. The apparatus defined in claim 7 wherein said speed sensor is a tachometer.

11. The apparatus defined in claim 10 wherein a signal transmitted by said tachometer is normalized so that a value 0 corresponds to casting apparatus idle and a value 1 corresponds to a preset value of said speed.

12. The apparatus defined in claim 7 wherein said proportional control is switched in at a level about 70% of said filling.

* * * * *